US005768924A

United States Patent [19]

Song

[11] Patent Number: 5,768,924

[45] Date of Patent: Jun. 23, 1998

[54] KEY CLIP

[76] Inventor: Chang June Song, 6740 Comstock Road, Richmond, British Columbia, Canada

[21] Appl. No.: 778,562

[22] Filed: Jan. 3, 1997

Related U.S. Application Data

[63] Continuation of Ser. No. 446,194, May 19, 1995, abandoned.

[51] Int. Cl.[6] ..... E05B 19/04

[52] U.S. Cl. ..... 70/408; 70/456.01

[58] Field of Search ..... 70/408, 456 R–458, 70/460; 24/458, 3.6, 3.11; 40/330, 634

[56] References Cited

U.S. PATENT DOCUMENTS

| | | | |
|---|---|---|---|
| 1,425,089 | 8/1922 | Henry | 24/3 |
| 1,462,193 | 7/1923 | Cook . | |
| 1,473,361 | 11/1923 | Tebbetts | 24/3 |
| 1,837,114 | 12/1931 | Cicourel | 40/33 |
| 1,886,110 | 11/1932 | Lippstadt . | |
| 2,071,021 | 2/1937 | Brandt | 24/3 |
| 2,231,308 | 2/1941 | Walsh et al. | 24/252 |
| 2,432,498 | 12/1947 | Bloomfield | 40/2 |
| 2,600,563 | 6/1952 | Michnoff | 24/3 |
| 2,894,302 | 7/1959 | Fox | 24/73 |
| 2,988,836 | 6/1961 | Oberfield | 40/330 |
| 3,173,280 | 3/1965 | Oberacker | 70/456 |
| 3,225,478 | 12/1965 | Rohmer | 40/330 |
| 3,267,534 | 8/1966 | Dansereau | 24/3 |
| 3,729,965 | 5/1973 | Gartner | 70/395 |
| 3,841,120 | 10/1974 | Gartner | 70/408 X |
| 3,955,725 | 5/1976 | Rese | 70/460 X |
| 4,562,712 | 1/1986 | Wolter | 70/456 R |
| 4,768,362 | 9/1988 | Schmalz, Jr. | 20/408 |
| 4,901,548 | 2/1990 | Deslandes | 70/408 |
| 4,986,100 | 1/1991 | Terada | 70/408 X |
| 5,038,590 | 8/1991 | Sawyer et al. | 70/458 |
| 5,099,665 | 3/1992 | Terada | 70/408 |
| 5,113,602 | 5/1992 | Levine et al. | 40/634 |
| 5,365,760 | 11/1994 | Song | 70/460 |

FOREIGN PATENT DOCUMENTS

| | | | |
|---|---|---|---|
| 205878 | 10/1959 | Austria . | |
| 1929325 | 2/1970 | Germany . | |
| 2031266 | 4/1980 | United Kingdom . | |
| 2243986 | 11/1991 | United Kingdom . | |
| 8303439 | 10/1983 | WIPO | 70/408 |
| 90/05821 | 5/1990 | WIPO . | |

*Primary Examiner*—Suzanne Dino
*Attorney, Agent, or Firm*—Townsend and Townsend and Crew LLP

[57] ABSTRACT

A key and clip combination useful for securing a spare key in a wallet or purse and for key identification. The clip is low profile and prevents the wallet or purse from becoming bulky. The clip may also include apertures for exposing the hole within the key used for placing the key on a key chain or key peg.

11 Claims, 1 Drawing Sheet

KEY CLIP

This is a Continuation of application Ser. No. 08/446,194, filed May 19, 1995 now abandoned, the disclosure of which is incorporated by reference.

BACKGROUND OF THE INVENTION

The present invention relates to keys and more particularly to devices for preventing key loss and for quick key identification.

People frequently lock themselves out of their cars, homes, apartments and other secured devices or areas. Many who have experienced loss of a key or wish to prevent this unpleasant event carry a spare key in their wallet or purse. These spare keys, however, tend to slip out and become easily lost unbeknownst to the owner.

In addition to perpetuating the undesirable condition of being locked out, a lost spare key may present other hazards. The lost spare key may be found and used by an unauthorized person for illegal purposes. Furthermore, during the time spent searching for the lost spare key, the individual is vulnerable to attack both because they are distracted and because they are denied access to a more secure area.

One desirable solution to this problem is described in U.S. Pat. No. 5,365,760 issued on Nov. 22, 1994, the contents of which are incorporated herein by reference in their entirety. However, it is also desirable to provide key clips which are readily fabricated and mounted to keys of varying widths and sizes.

SUMMARY OF THE INVENTION

The present invention provides a key and key securing device that enables the key to be easily and securely placed in a wallet or purse and can be used to facilitate quick identification of one specific key among many. The key clips are readily fabricated and mounted on the key.

According to one embodiment of the present invention, a clip fits over a top portion of the key and allows the key to be securely attached inside a wallet or purse. The clip includes a portion which fits snugly into an insert formed in the key to secure the clip to the key and prevent the clip from swiveling. Thus, the present invention prevents the key from detaching from the clip or clamped object and becoming lost.

The clip, in certain embodiments, may also include an opening for exposing a hole commonly contained within the key for receiving a key ring or key peg. In this manner, the present invention does not limit the key to a single secure location and the key may also be placed on a key ring or key fob. The clip may also be used as a visual and/or tactile signaling mechanism to readily identify a particular key on the ring or fob.

According to another embodiment of the present invention, the clip device is formed of a single piece of metal and requires no hardware to secure it to the key. This feature reduces the complexity of the present invention and eliminates the need for special tools to use or disengage the invention. The construction of the present invention also provides a slim profile to reduce wallet bulk and minimize undue wear on the wallet.

Still another slim and stylish embodiment is described which is easily installed onto keys which have been specially machined. A single size clip may be used to accommodate a variety of key sizes and shapes.

DESCRIPTION OF THE PREFERRED EMBODIMENT

Figure 1A:
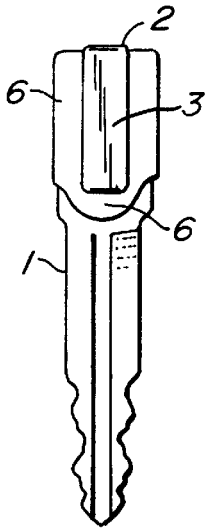
FIG. 1A is a top view of a key and clip according to an embodiment of the present invention.

FIG. 1A is a top view of a key 1 and key securing device, or clip 2, according to an embodiment of the present invention. When key 1 is slipped on a wallet, purse, or pocket, clip 2 also functions as a means of quickly recognizing the key. For example, a woman approaching a car in a darkened garage can quickly reach into a dark purse and grab the appropriate key by feeling for the key with clip 2 attached. In this manner, clip 2 provides a tactile means of quickly recognizing the appropriate car key and reduces the woman's chances of becoming a crime victim.

Also shown in FIG. 1A is a tongue 3 of clip 2. Tongue 3 is formed to force lip 4 against any object slipped underneath lip 4. Tongue 3 slips over the inner partitions of a wallet, for example, to secure key 1 within the wallet. Optionally, tongue 3 may be used to secure key 1 within a purse or a shirt pocket. The resilient nature of tongue 3 enables clip 2 to secure key 1 to surfaces of varying thickness. This helps to avoid loss or misplacement of a key. In the embodiment shown in FIG. 1, the entire top portion of the key 1 is covered by the clip 2. The clip may be formed from thin sheet metal of any type. The clip may be created from metal sheeting designed to enhance the appearance of the key. Other embodiments may be formed from plastic or other materials.

Figure 1B:
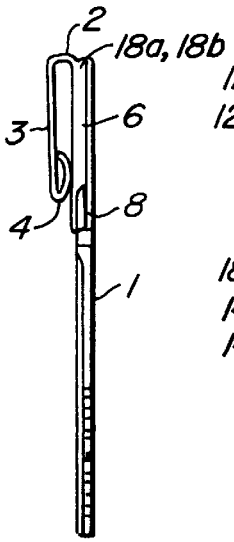
FIG. 1B is a side view of the key and clip of FIG. 1A.

FIG. 1B is a side view of the key 1 and clip 2. Here, it is shown that the clip 2 has a body 6 which covers the top portion of the key 1. The clip may be formed from a single piece of material to simplify manufacture and reduce cost. Once fabricated, the clip 2 is installed on a key 1 by sliding the clip 2 into a groove 8 formed in the side edges of the key 1. FIG. 1B also shows the lip 4 of the tongue 3 of the clip 2.

The lip 4 is formed to press against the body of the key clip 6. Existing keys may be adapted for use with clips of the present invention by simple machining of the key.

Figure 2A:
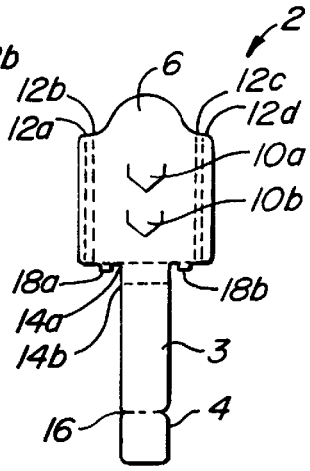
FIG. 2A is a top view of the clip of FIG. 1.

FIG. 2A depicts the shape and design of one specific clip 2 of the present invention. The clip is formed from a piece of material which is folded along the dotted lines 12, 14, 16, 18. For example, the lip 4 is folded along line 16 against the tongue 3 which is folded along two lines 14*a* and *b*. The body 6 of the clip 2 is shaped by folding along side edges 12*a–d*. The side edges fit within a groove 8 formed on the key. Retaining tabs 10*a,b* may be included on the clip body to prevent slippage of the clip 2 once it is installed on a key. Stop tabs 18*a* and *b* may be provided to ensure proper placement of the clip 2 on a key. The design of the clip body 6 serves to firmly anchor clip 2 to key 1 and to prevent clip 2 from swiveling. If clip 2 were allowed to swivel, key 1 could easily detach from the wallet or other device to which it is secured. Furthermore, key 1 could itself become separated from clip 2.

Figure 2B:
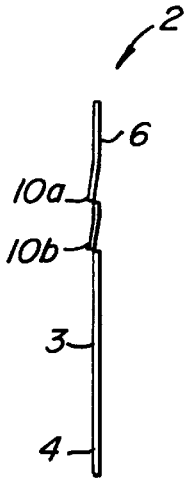
FIG. 2B is a side view of the clip of FIG. 1.
Figure 4B:
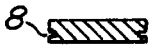
FIG. 4B is a second side cut-away view of another size of key of FIG. 3.
Figure 4A:
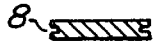
FIG. 4A is a first side cut-away view of one size of the key of FIG. 3.
Figure 3:
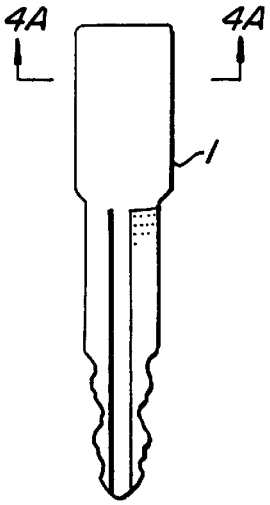
FIG. 3 is a top view of the key of FIG. 1.

FIG. 2B shows the retaining tabs 10*a, b* are raised and serve to inhibit movement of the clip 2 along the face of the key 1 in a direction which would remove the clip from the key once installed. The result is a key clip which is sturdy, simple to manufacture and install, attractive, and low in profile. As shown in FIG. 3 and FIG. 4, the clip is designed such that it may be installed on any thickness of key 2. A single clip 2 may be used if the groove 8 is positioned the same distance from one face of a key 1. Such an installation permits easy stocking of key clips, as they may be used with any number of key designs. FIG. 1B also illustrates how clip 2 fits over key 1 with a low profile. The low profile of clip 2 means that bulk is not added to the wallet or purse when the key/clip combination of the present invention is used.

Other methods of securing a key in a wallet rely on forming the key into bulky plastic cards or include other bulky attachment mechanisms that unnaturally expand the wallet, purse or pocket. The additional bulk added by these devices distorts the shape of the wallet, purse or pocket resulting in an unsightly appearance and accelerating the wear of these objects.

In contrast, the low profile of the present invention does not cause unsightly bulges or add unnecessary bulk to the object to which the key is secured. Thus, the neatness and functionality of the object is maintained and the present invention does not accelerate wear of the object.

FIG. 5 shows an alternate embodiment of the key clip 32 according to the present invention. This figure also shows that the key clip may be used with keys having an aperture or hole 40. Key 30 may be provided with a hole 40 useful for securing key 30 to a key ring or for placing key 30 on a key peg or key fob. Clip 32 includes an aperture and fits over key 30 as shown so as not to obscure hole 40 of key 32. In this manner, the key clip 32 functions to enable quick, tactile identification of a key. For example, people frequently fumble for a specific key in dark locations. The use of a key clip allows a person to rapidly identify a specific frequently used key. The low profile of the key clip 32 ensures that a key with the clip on it is not any bulkier than other keys on the ring.

Figure 6B:
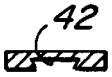
FIG. 6B is a side cut-away view of the key of FIG. 6A.
Figure 5A:
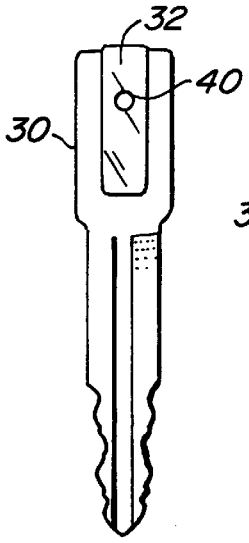
FIG. 5A is a top view of a key and clip according to second embodiment of the present invention.
Figure 5B:
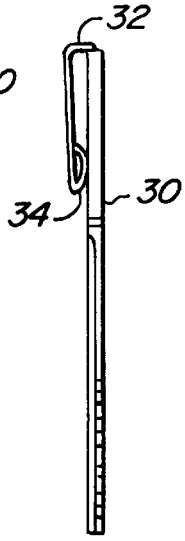
FIG. 5B is a side view of the key and clip of FIG. 5A.
Figure 6A:
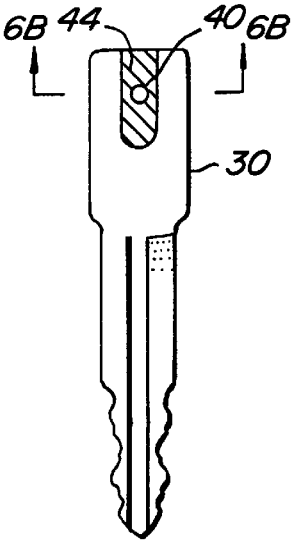
FIG. 6A is a top view of the key of FIG. 5.

FIG. 5B is a side view of the key clip 32 of FIG. 5A. No grooves are required in the edge of the key in this embodiment. Instead, as shown in FIG. 6A, a recess 44 is formed in the top of a key 30. The recess 44 is formed to have a beveled cross section as shown in FIG. 6B. This recess 44 may be formed using standard machining techniques.

Figure 7:
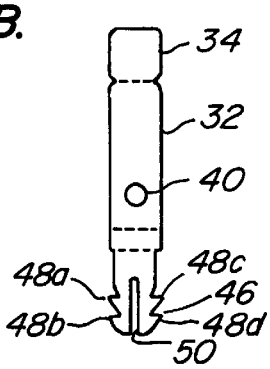
FIG. 7 is a top view of the clip of FIG. 5.

FIG. 7 shows an unfolded clip 32 of the present invention. The clip is shaped to fit within the recess 44. The clip 32 may be formed from a single piece of material, and is folded to form the final clip. Folds are made along the dotted lines of FIG. 7. End 46 is inserted into the recess 44. Tips 48*a–d* and gap 50 allows the end 46 to be easily inserted. Once fully inserted, the tips 48*a–d* prevent the clip from being removed from the recess 44, as the tips bite into the material of the key. Such an approach allows quick and easy installation without special tools. It also ensures that the clip remains fastened on the key without slipping or rotation. Further, the clip may be used with any shape of key. Round, square, octagonal, or other key head shapes may be used. All that is required is that a bevelled recess 44 be machined into the top face of the key.

Preferred embodiments of the invention have now been described. Variations and modifications will be readily apparent to those of skill in the art. For this reason, the invention is to be construed in light of the claims.

What is claimed is:

1. A key clip in combination with a key, the combination comprising:

a key having an elongated groove formed along at least a first edge of said key;

a key clip, formed from a single piece of material and shaped for slidable insertion into said groove formed along at least said first edge of said key, said key clip having a tongue for coupling said key to an object.

2. The key clip of claim 1 wherein said key is a square ended key having an aperture formed therethrough for receiving at least one of a key ring or key peg, said key clip having a corresponding opening to expose said aperture of said key when said key clip is inserted on said key.

3. The key clip of claim 1 wherein said key clip is formed of a single flat piece of metal.

4. The key clip of claim 1, wherein said key clip has a tab for retaining said key clip on said key when said key clip is inserted on said key.

5. An apparatus in combination with a key for use in securing the key to an object, the apparatus comprising:

a piece of material folded to form a clip wherein said clip is adapted to fit over a top portion of the key and to mate with a bevelled recess formed in the top portion of the key, and wherein said clip includes:

a tongue located on a front portion of said clip for engaging the object; and an insert portion adapted to secure said clip to the key by slidably fitting within the bevelled recess.

6. The apparatus of claim 5 wherein said clip has an aperture for exposing a hole contained in a key.

7. The apparatus of claim 5, wherein said insert portion has a tab for retaining said insert portion within the bevelled recess.

8. A key clip in combination with a key, the combination comprising:

a key having a bevelled recess formed on a top portion of said key;

a key clip, formed from a single piece of material and shaped for slidable insertion into said bevelled recess formed on said top portion of said key, said key clip having a tongue for coupling said key to an object.

9. The key clip of claim 8, wherein said key clip has a tab for retaining said key clip on said key when said key clip is inserted on said key.

10. An apparatus for securing a key having elongated grooves formed along edges of the key to an object, the apparatus comprising:

a piece of material folded to form a clip wherein said clip is adapted to fit over a top portion of the key and to mate with the grooves formed along the edges of the key, and wherein said clip includes:

a tongue located on a front portion of said clip for engaging the object; and an insert portion having flaps adapted to secure said clip to the key by slidably fitting within the grooves formed along the edges of the key.

11. The apparatus of claim 10, wherein said insert portion has a tab for retaining said insert portion within the bevelled recess.

* * * * *